US006623099B2

(12) United States Patent
Matsumura

(10) Patent No.: US 6,623,099 B2
(45) Date of Patent: Sep. 23, 2003

(54) INK JET RECORDING APPARATUS AND WASTE LIQUID COLLECTION MEMBER USED THEREFOR

(75) Inventor: Hideaki Matsumura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/056,002

(22) Filed: Jan. 28, 2002

(65) Prior Publication Data

US 2002/0109749 A1 Aug. 15, 2002

(30) Foreign Application Priority Data

Feb. 1, 2001 (JP) ..... 2001-025626

(51) Int. Cl.[7] ..... B41J 2/165
(52) U.S. Cl. ..... 347/35
(58) Field of Search ..... 347/35, 36, 29, 347/30, 31

(56) References Cited

U.S. PATENT DOCUMENTS 6,267,465 B1 * 7/2001 Sawicki ..... 347/36
6,299,279 B1 * 10/2001 Asada ..... 347/36
6,375,305 B2 * 4/2002 Sugimoto et al. ..... 347/36

FOREIGN PATENT DOCUMENTS

JP 57-22065 2/1982
JP 403227658 A * 10/1991 ..... 347/37
JP 408238782 A * 9/1996 ..... 347/36

* cited by examiner

*Primary Examiner*—Shih-wen Hsieh
(74) *Attorney, Agent, or Firm*—Fitzpatrick, Cella, Harper & Scinto

(57) ABSTRACT

An ink jet recording apparatus comprises first recovery device for recovering the black ink discharge portion for discharging black ink, second recovery device for recovering the color ink discharge portion for discharging color ink, a waste liquid collection member provided with a waste liquid absorbent for absorbing waste liquid exhausted from the first recovery device and the second recovery means, and a waste liquid correction frame for housing the waste liquid absorbent; a first waste liquid carrying path for carrying waste liquid exhausted from the first recovery means to the waste liquid collection member, and a second waste liquid carrying path for carrying waste liquid exhausted from the second recovery means to the waste liquid collection member. For this ink jet recording apparatus, waste liquid exhausted from the first waste liquid carrying path is exhausted to the inner bottom face of the waste liquid collection frame, and waste liquid exhausted from the second waste liquid carrying path is exhausted to the waste liquid absorbent, hence making it possible to perform waste liquid process efficiently for the execution of a highly reliable printing operation.

19 Claims, 4 Drawing Sheets

INK JET RECORDING APPARATUS AND WASTE LIQUID COLLECTION MEMBER USED THEREFOR

BACKGROUND OF THE INVENTION

1. Field of the Invention

The present invention relates to an ink jet recording apparatus capable of obtaining high quality images on a printing medium, and also, relates to a waste liquid collection member used therefore. More particularly, the invention relates to an ink jet recording apparatus that enables black ink and color ink or pigment ink and dyestuff ink to react and solidly fixes and makes them overly viscous on a printing medium, as well as to a waste liquid collection member used therefore.

The present invention is applicable to all the equipment that uses a printing medium, such as paper, cloth, unwoven cloth, OHP sheet, and as a specific equipment to which the invention is applicable is a printer, a copying machine, facsimile equipment, or other office equipment, or a large-scale production equipment, among some others.

2. Related Background Art

The ink jet recording method is utilized for a printer, a copying machine, facsimile equipment, and others, because with this method, it is easier to make the apparatus smaller with a lesser amount of noises at a lower running cost, as well as the ease with which color printing is made possible.

However, the problems characteristic of the ink jet printing method may be encountered in some cases as given below.

1) Printing is executed by discharging ink droplets from an ink jet head to a recording medium, such as paper, OHP film. As a result, fine ink droplets (mist) generated aside from the main ink droplets discharged, and splash of ink droplets discharged to a printing medium may cause ink adhesion to the ink discharge port surface of the ink jet head, and these are brought to get together around ink discharge ports. Also, if foreign substance, such as paper particles, adheres to them, ink discharge is impeded to ensue in the twisted discharge in the unexpected direction or some hindrance may take place, such as to disable ink discharges.

2) At non-printing time, to be exact, with no discharge being made for a long time, ink in an ink jet head is evaporated and dried to clog the nozzle with the ink that has become overly viscous and solidified. This condition causes discharge defects, such as twisted discharge, disabled discharge.

The ink jet recording apparatus is generally provided with the following recovery means in order to solve the aforesaid problems 1) and 2).

At non-printing time, the ink jet head is capped to prevent ink in the nozzle from being evaporated and dried so as not to allow it to become overly viscous or solidified. Also, if ink should become overly viscous and solidified to cause discharge defects or any foreign substance that has not been removed by a blade adheres to the discharge port surface, such overly viscous ink in the nozzle is exhausted by use of a suction pump connected with the cap, thus performing the recovery process for obtaining normal discharges.

The exhausted ink is absorbed by a waste ink absorbent provided for the ink jet recording apparatus through the tube or the like that is arranged on the downstream side of the suction pump. Here, the capacity of the waste ink absorbent is determined the numbers of defective prints, the frequency of recovery operations, the amount of ink pushed out or sucked per recovery operation, and the amount of ink mist discharged. However, from the viewpoint of the entire structure of the apparatus, it is better to make the capacity of the waste ink absorbent smaller for more compact arrangement. Then, there is no restriction on the location of its installation to make it possible to anticipate the lower cost installation thereof.

Nevertheless, if the capacity of the waste ink absorbent is made smaller than the required amount, the waste ink absorbent should be replaced more frequently to make its maintenance more complicated, among some others. Also, if the capacity is made to deal with the required amount, the size of the waste ink absorbent should become larger to invite not only increased costs, but to make the ink jet recording apparatus main body larger eventually.

To cope with such situation, there is disclosed an art to minimize the volume of a waste ink absorbent by the utilization of ink evaporation in the specification of Japanese Patent Laid-Open Application 57-22065.

Meanwhile, when a color image is obtained on the printing medium that is the so-called ordinary paper sheet by use of the apparatus utilizing the ink jet printing method, it is difficult to from the image that does not show any ooze between black and other colors, thus degrading color image quality considerably.

As a result, there is used an art to suppress ooze between black and other colors in such a manner that the black ink and color ink discharged by an ink jet head are allowed to act on a printing medium to solidify and make them overly viscous, thus suppressing ooze between black and such color thus discharged. To solve the problems characteristics of the ink jet recording apparatus while using this art, it is required to provide recovery means both for the black ink jet nozzle and the color ink jet nozzle in consideration of the behavior of the ink system in which black ink and color ink should react to be solidified and become overly viscous.

Also, in recent years, there has been a tendency to use the black ink that contains pigment component in order to elevate the quality of black characters of a text document or the like.

Under such circumstances, when a suction recovery process is performed for the aforesaid ink jet recording apparatus, there exist eventually two kinds of ink materials, black and other colors, in the waste liquid absorbed by the waste liquid absorbent.

However, these two kinds of waste liquids have the properties to become overly viscous when mixed, and the mixture of waste liquids is accumulated in the absorbent to make it difficult for them to be absorbed eventually.

Also, in order to avoid the accumulation of waste liquids, it may be possible to provide an absorbent for each of those used for black and colors, respectively. However, this arrangement results in considerably higher costs, and the ink jet recording apparatus main body should also be made larger.

Further, although the absorption of dyestuff color ink to the absorbent is stable substantially with respect to its use conditions or the like, the status of waste liquid of pigment black ink changes drastically depending on its use conditions.

In other words, at the time of continuous use under high humidity, there is a need for keeping the absorbent in condition so as not to allow waste liquid to over flow even when the ink jet recording apparatus is tilted, because waste liquid remains to be in the state of fluid. On the contrary, at the time of intermittent use under low humidity, or the like, there is almost no absorption to the absorbent, and the pigment component is solidified and accumulated. As a result, a problem is encountered that the exhaust port of waste liquid is clogged.

SUMMARY OF THE INVENTION

It is an object of the present invention to provide a highly reliable ink jet recording apparatus to form images by discharging reactive ink to a printing medium, which is capable of performing waste liquid process efficiently so as not to allow waste liquid to be accumulated to clog the exhaust port of waste liquid, and also, to provide a waste liquid collection member used for such apparatus.

It is another object of the invention to provide an ink jet recording apparatus comprising first recovery means for recovering the black ink discharge portion for discharging black ink; second recovery means for recovering the color ink discharge portion for discharging color ink; a waste liquid collection member provided with a waste liquid absorbent for absorbing waste liquid exhausted from the first recovery means and the second recovery means, and a waste liquid correction frame for housing the waste liquid absorbent; a first waste liquid carrying path for carrying waste liquid exhausted from the first recovery means to the waste liquid collection member; and a second waste liquid carrying path for carrying waste liquid exhausted from the second recovery means to the waste liquid collection member. For this ink jet recording apparatus, waste liquid exhausted from the first waste liquid carrying path is exhausted to the inner bottom face of the waste liquid collection frame, and waste liquid exhausted from the second waste liquid carrying path is exhausted to the waste liquid absorbent.

It is still another object of the invention to provide an ink jet recording apparatus comprising first recovery means for recovering the pigment ink discharge portion for discharging pigment ink; second recovery means for recovering the dyestuff ink discharge portion for discharging dyestuff ink reacting to pigment ink; a waste liquid collection member provided with a waste liquid absorbent for absorbing waste liquid exhausted from the first recovery means and the second recovery means, and a waste liquid correction frame for housing the waste liquid absorbent; a first waste liquid carrying path for carrying waste liquid exhausted from the first recovery means to the waste liquid collection member; and a second waste liquid carrying path for carrying waste liquid exhausted from the second recovery means to the waste liquid collection member. For this ink jet recording apparatus, waste liquid exhausted from the first waste liquid carrying path is exhausted to the inner bottom face of the waste liquid collection frame, and waste liquid exhausted from the second waste liquid carrying path is exhausted to the waste liquid absorbent.

It is a further object of the invention to provide a waste liquid collection member for use of an ink jet recording apparatus having a waste liquid absorbent for absorbing waste liquid and a waste liquid collection frame housing the waste liquid absorbent. For this waste liquid collection member, waste liquid exhausted from the black ink discharge portion for discharging black ink is exhausted to the inner bottom face of the waste liquid collection frame, and waste liquid exhausted from the color ink discharge portion for discharging color ink reacting to black ink is exhausted to the waste liquid absorbent.

It is still a further object of the invention to provide a waste liquid collection member for use of an ink jet recording apparatus having a waste liquid absorbent for absorbing waste liquid, and a waste liquid collection frame housing the waste liquid absorbent. For this waste liquid collection member, waste liquid exhausted from the pigment ink discharge portion for discharging pigment ink is exhausted to the inner bottom face of the waste liquid collection frame, and waste liquid exhausted from the dyestuff ink discharge portion for discharging dyestuff ink reacting to pigment ink is exhausted to the waste liquid absorbent.

In accordance with the present invention, the ink jet recording apparatus that forms images by discharging reactive ink to a printing medium makes it possible to collect waste liquid efficiently without any direct reaction between waste liquids themselves that may impede absorption to the absorbent or any possible clogging of the exhaust port by the accumulation thereof, because black ink or pigment ink is exhausted to the inner bottom face of the waste liquid collection frame, and color ink or dyestuff ink is exhausted to the waste liquid absorbent for dispersion when overly viscous ink in each nozzle is exhausted by means of the suction pump connected with the cap for the execution of recovery process to recovery discharges to the normal condition.

Also, the state of pigment black ink is kept in the waste liquid absorbent even when it is in the form of liquid, and there is no possibility that waste liquid leaks outside the apparatus. Further, even when pigment black ink is condition to be overly viscous due to drying, waste liquid can be dispersed flatly on the inner bottom face of the waste liquid collection member. In a case where it is accumulated, the distance from the exhaust port thereto can be made long to enable the accumulated ink on the opening and grooved portions to flow so as not to clog them.

DETAILED DESCRIPTION OF THE PREFERRED EMBODIMENTS

Figure 1:
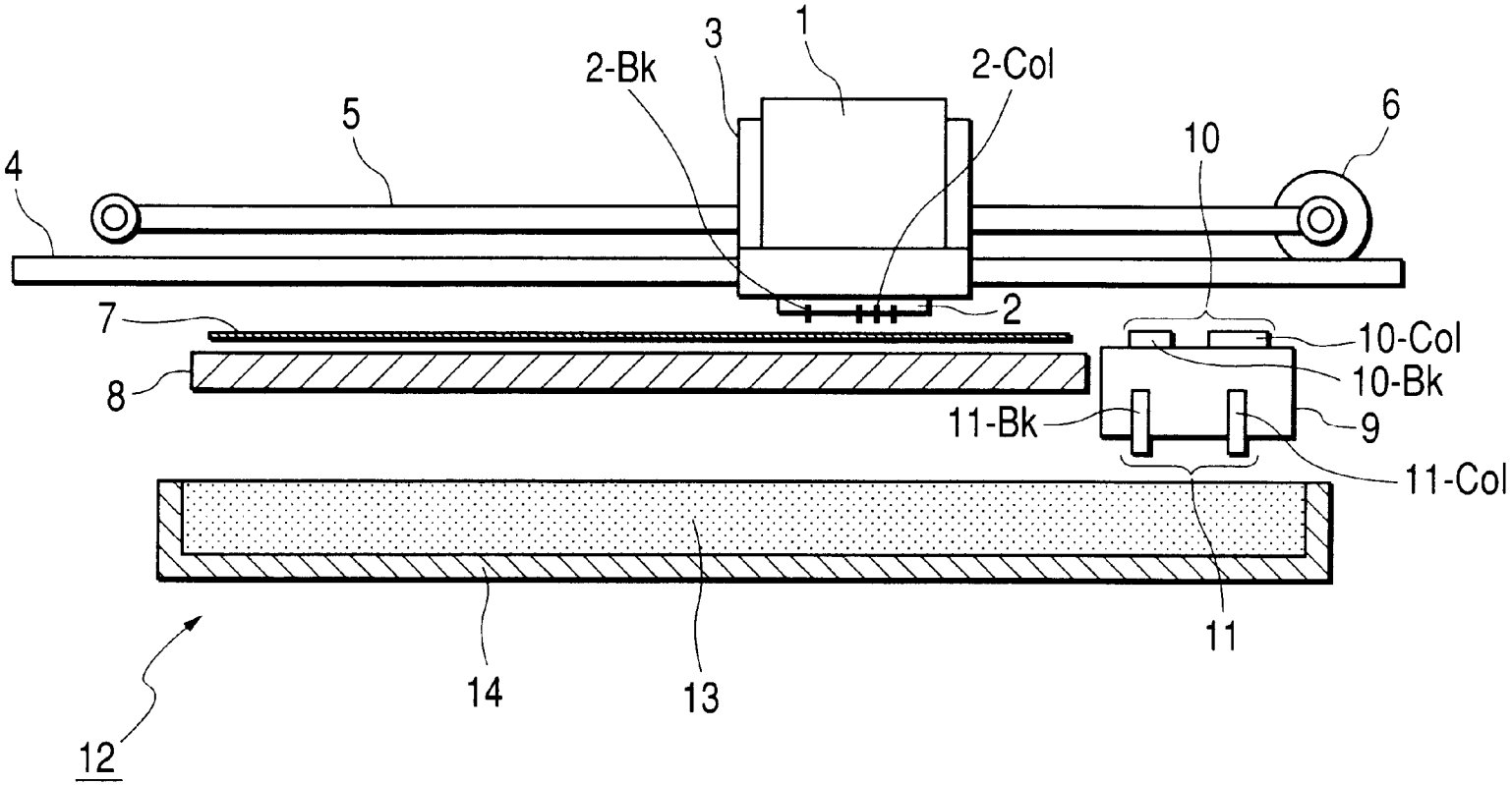
FIG. 1 is a view that schematically shows the general structure of circumference of the waste liquid collection member of an ink jet recording apparatus.

Hereinafter the preferred embodiments will be described in detail in accordance with the present invention. Prior to the description thereof, the general structure of the circumference of the waste liquid collection member of an ink jet recording apparatus is shown in FIG. 1. A reference numeral 1 designates an ink jet head; 2, an ink jet discharge unit; 2-Bk, a black ink discharge portion; and 2-Col, a color ink discharge portion.

The ink jet head 1 is provided with the black ink discharge portion 2-Bk and the color ink discharge portion 2-Col, which are nozzle array having a plurality of nozzles. The color ink discharge portion 2-Col is formed with a cyan ink discharge section, a magenta ink discharge section, and an yellow ink discharge section in that order from the left side in FIG. 1. A reference numeral 3 designates a carriage; 4, a guide shaft; 5, a driving belt; 6, a driving motor; 7, a printing medium; and 8, a platen.

Figure 7:
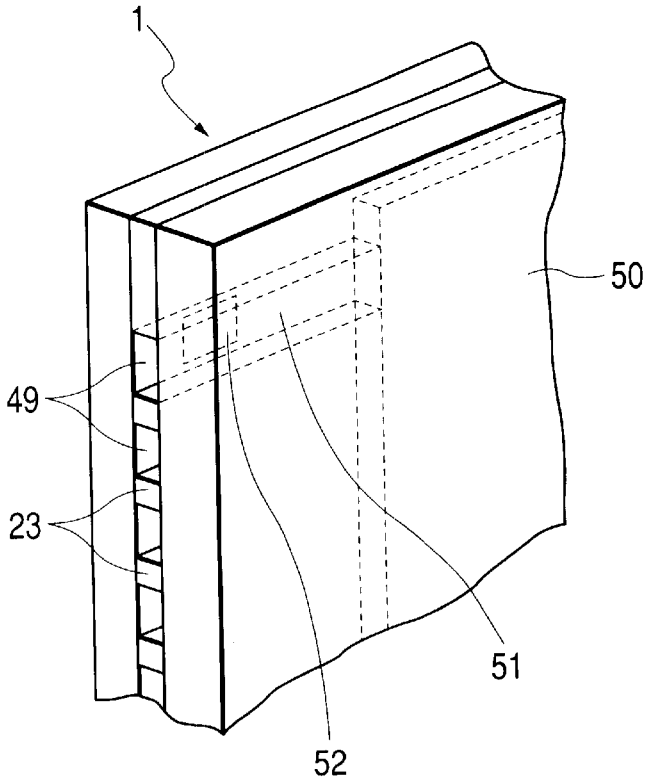
FIG. 7 is a partial perspective view that schematically shows the structure of an ink jet head.

FIG. 7 is a partial perspective view that schematically shows the structure of the ink discharge unit (one discharge port array) of recording means (recording head) 1. In FIG. 7, there are arranged for the discharge port surface 23 that faces a recording material, such as a recording sheet, with a specific gap (approximately 0.3 to 2.0 mm, for example) therewith, plural discharge ports 49 formed at specific pitches, and also, the electrothermal converting element (heat generating resistive element or the like) 52 that generates energy used for discharging ink, which is arranged along the wall face of each liquid path 51 communicated with a common liquid chamber 50 and each discharge port 49. The recording head 1 is guided and supported in the positional relations so that the discharge ports 49 are arranged in the direction intersecting with the main scan traveling direction. Thus, recording means (recording head) 1 is structured in order to drive the corresponding electrothermal converting element 52 (apply pulse voltage thereto) in accordance with image signals or discharge signals for generating film boiling in ink in the liquid path 51 to discharge ink from the discharge port 49 by the pressure exerted at that time.

The carriage 3 positions the ink jet head 1 for mounting it thereon. Then, the guide shaft 4 that extends in the main scanning direction supports the carriage 3. The driving belt 5 is provided for transmitting the driving power of the driving motor 6 to enable the carriage 3 to reciprocate. Also, the printing medium 7 is conveyed in a state of the printing surface thereof being regulated by the platen 8. Here, a reference numeral 9 designates a recovery unit; 10, a capping unit; 10-BK, a cap for use of the black ink discharge portion; and 10-Col, a cap for use of the color ink discharge portion.

The recovery unit 9 is arranged on the home position side set on the right side in FIG. 1. For the recovery unit 9, the capping unit 10 is provided each for the black ink discharge portion 2-Bk and the color ink discharge portion 2-Col of the ink jet head 1, respectively. The capping unit 10 can move in the direction upward and downward. Here, the cap 10-Bk for use of the black ink discharge portion and the cap 10-Col for use of the color ink discharge portion form the capping unit 10.

Also, for the inside of the recovery unit 9, a pump unit (not shown) is arranged.

The pump unit is arranged to generate negative pressure when the capping unit 10 is used for capping the discharge port portions 2 for the performance of a suction recovery process or the like.

In other words, the cap 10-Bk for use of the black ink discharge portion and the pump unit (not shown) form first recovery means for recovering the black ink discharge portion 2-Bk, and the cap 10-Col for use of the color ink discharge portion and the pump unit (not shown) form second recovery means for recovering the color ink discharge portion 2-Col. Here, a reference numeral 11 designates a waste liquid exhausting unit; 11-Bk, a black ink waste liquid exhaust portion; 11-Col, a color ink waste liquid exhaust portion; 12, a waste liquid collection member; 13, a waste liquid absorbent; and 14, a waste liquid collection frame.

The black ink waste liquid exhaust portion 11-Bk serving as a first waste liquid carrying path, and the color ink waste liquid exhaust portion 11-Col serving as a second waste liquid carrying path form the waste liquid exhaust unit 11 that serves as the waste liquid carrying path. The waste liquid collection frame 14 and waste liquid absorbent 13 form the waste liquid collection member 12. The waste liquid collection fame 14 is in a form to surround the bottom face and side face of the waste liquid absorbent 13.

With the structure thus arranged, the ink discharge unit 2 of the ink jet head 1 mounted on the carriage 3 is positioned on the plane extruded from the carriage 3 downward when printing is operated, and the printing medium 7 is positioned between two sets of conveying rollers (not shown). The discharge port formation surface of the ink discharge unit 2 parallels and faces the printing medium 7 pressed to the guiding surface by the platen 8 for printing.

Also, when the carriage 3 is positioned in the home position, the cap 10-Bk for use of the black ink discharge and the cap 10-Col for use of the color ink discharge cap the black ink discharge portion 2-Bk and the color ink discharge portion 2-Col, respectively, to prevent ink in the discharge ports of the ink jet head 1 from being evaporated to become overly viscous or solidified for the prevention of discharge defects.

Then, in the execution of a suction recovery process, the pump unit (not shown) in the recovery unit 9 exerts negative pressure in a state of the ink discharge unit 2 being capped by use of the capping unit 10. In this way, ink in the ink jet head 1 thus sucked is exhausted from the pump unit to the waste liquid collection member 12 from the waste liquid absorbent 13 and the waste liquid collection frame 14 through the black ink waste liquid exhaust portion 11-Bk and the color ink portion 11-Col.

(First Embodiment)

Figure 2:
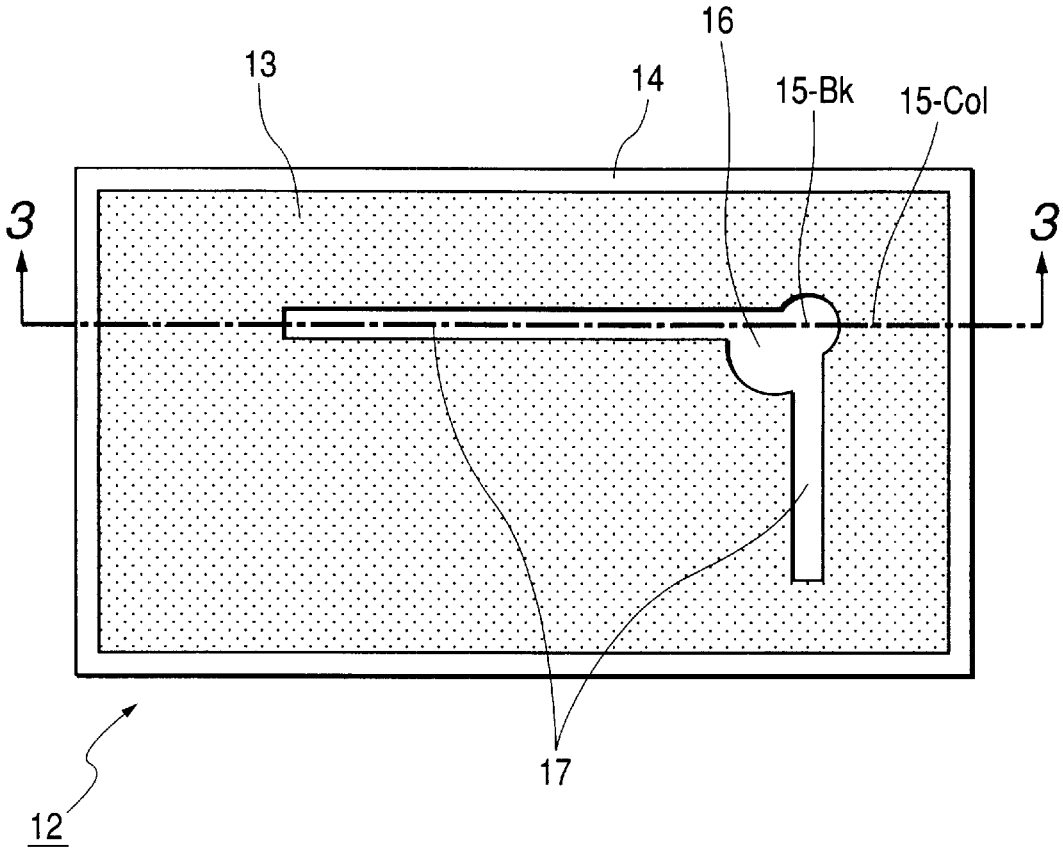
FIG. 2 is a view that illustrates the waste liquid collection member in accordance with a first embodiment of the present invention.
Figure 3:
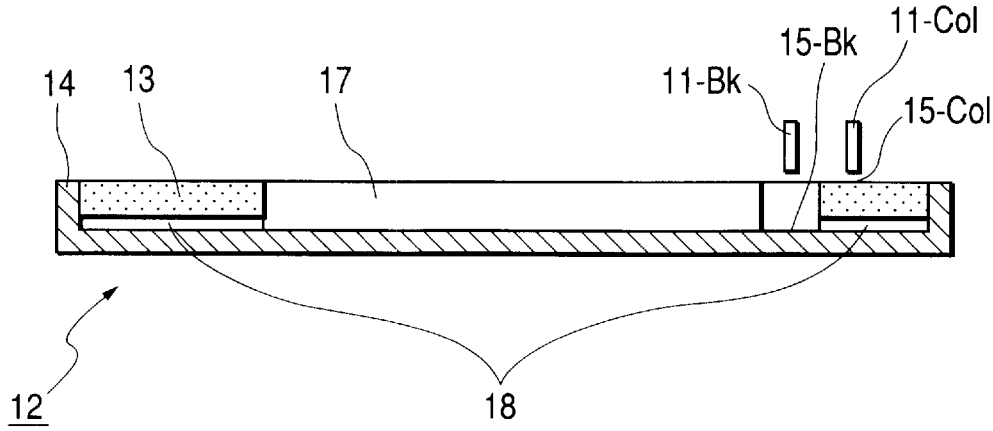
FIG. 3 is a cross-sectional view that shows the waste liquid collection member in accordance with the first embodiment of the present invention, taken along line 3—3 in FIG. 2.

FIG. 2 is a view that illustrates the waste liquid collection member in accordance with a first embodiment of the present invention. FIG. 3 is a cross-sectional view that shows the waste liquid collection member in accordance with the first embodiment of the present invention, taken along line 3—3 in FIG. 2.

The waste liquid collection frame 14 and the waste liquid absorbent 13 form the waste liquid collection member 12, and the waste liquid collection frame 14 is formed to surround the bottom face and side face of the waste liquid absorbent 13. The waste liquid absorbent 13 is provided with an opening portion 16 and a groove portion 17.

The black ink waste liquid that contains pigment component is exhausted to a waste liquid exhausting point 15-Bk from the black ink waste liquid exhaust portion 11-Bk, and the color ink waste liquid is exhausted to a color ink exhausting point 15-Col from the waste liquid exhaust portion 11-Col.

The exhaust black is at first expanded flatly on the smooth inner bottom face of the waste liquid collection frame 14. The waste liquid absorbent 13 is provided with a low-density layer 18 on the contact surface side with the inner bottom face of the waste liquid collection frame 14. As a result, the exhausted black ink is conducted to the low-density layer 18, thus being expanded flatly.

Here, the conditions of the black ink waste liquid are caused to change greatly depending on the surrounding environment and the use frequency of an ink jet recording apparatus.

In a case of continuous use under high humid environment or the like, the waste liquid remains in a state of fluid. As a result, the black ink exhausted to the waste liquid exhausting point 15-Bk is conducted to the low-density layer 18, and while in the process of being expanded flatly, it is sucked by the waste liquid absorbent 13 and retained therein. There is no possibility, therefore, that the waste liquid is allowed to flow outside the apparatus.

Next, in a case of the ink jet recording apparatus being used intermittently under low humid environment, the pigment component in the waste black ink liquid becomes overly viscous and solidly fixed. Then, though slightly conducted to the low-density layer 18 and expand flatly, the waste liquid tends to be accumulated. Here, the opening portion 16 is arranged for the waste liquid absorbent 13 to provide a distance between the black ink waste liquid exhaust portion 11-Bk and the waste liquid exhausting point 15-Bk. As a result, there is a space secured for enabling the accumulated substance to reside so as not to allow it to clog the black ink waste liquid exhaust portion 11-Bk under any circumstance.

Also, there is arranged the groove 17 for the waste liquid absorbent 13, which is connected with the opening portion 16, and as the waste liquid is exhausted, the accumulated substance moves along the groove 17. In this manner, it is arranged to prevent the accumulated substance from clogging the black ink waste liquid exhaust portion 11-Bk.

On the other hand, the color ink is directly exhausted to the waste liquid exhausting point 15-Col above the waste liquid absorbent 13. Therefore, the exhausted color ink is conducted into the waste liquid absorbent 13 and dispersed and retained therein.

Also, since the color ink is dyestuff ink, the state of the waste liquid thereof almost remains unchanged irrespective of the use environment or use frequency. It is absorbed into the waste liquid absorbent 13.

Here, the color ink has extremely high permeability. Therefore, even if the color ink and the black ink are allowed to react at a part inside the waste liquid absorbent 13, resulting in the presence of some clogged portion due to solid fixation and over viscosity, the color ink waste liquid is being dispersed by some other part of the waste liquid absorbent 13, and there is no possibility that the waste liquid is allowed to overflow before the capacity of the waste liquid absorbent 13 has been used completely.

(Second Embodiment)

Figure 4:
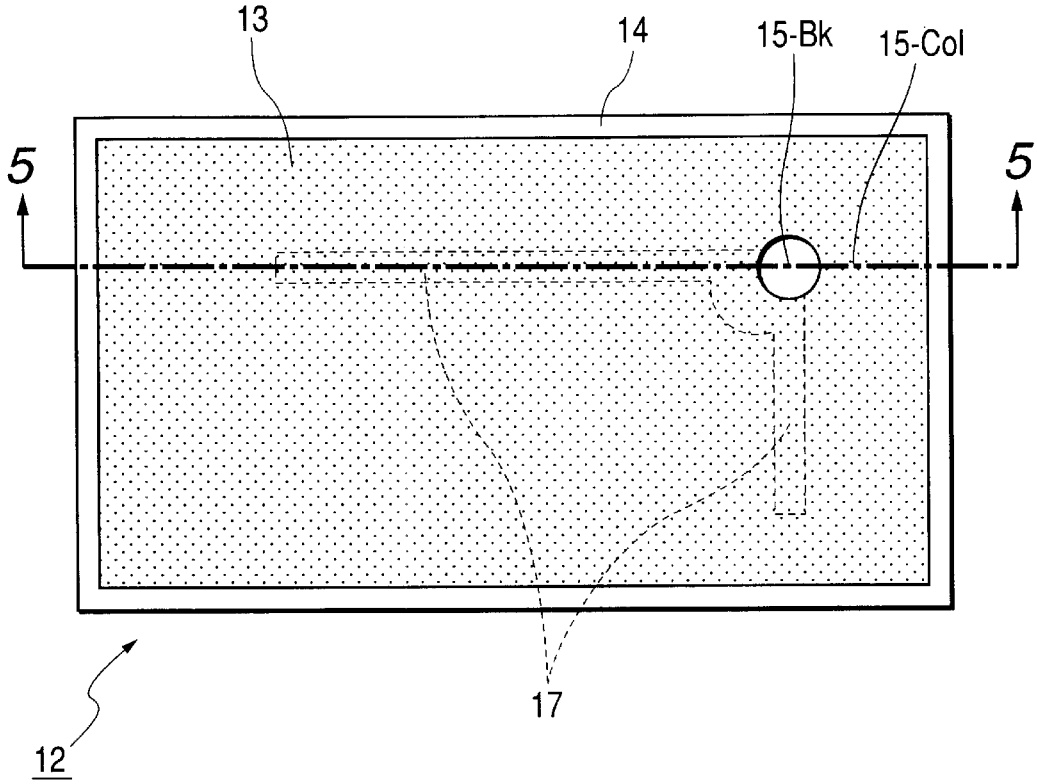
FIG. 4 is a view that illustrates the waste liquid collection member in accordance with a second embodiment of the present invention.
Figure 5:
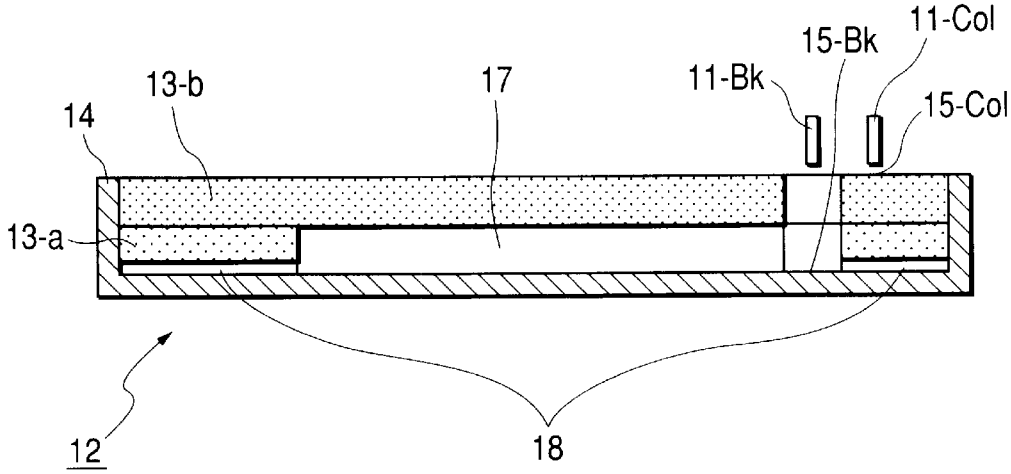
FIG. 5 is a cross-sectional view that shows the waste liquid collection member in accordance with the second embodiment of the present invention, taken along line 5—5 in FIG. 4.

FIG. 4 is a view that illustrates the waste liquid collection member in accordance with a second embodiment of the present invention. FIG. 5 is a cross-sectional view that shows the waste liquid collection member, taken along line 5—5 in FIG. 4. For the same parts as those appearing in the first embodiment, the description thereof will be omitted.

The structure of the second embodiment is almost the same as that of the first embodiment, but two waste liquid absorbents 13-*a* and 13-*b* form the waste liquid absorbent 13. For the waste liquid collection member 13-*b* forming the upper layer, an opening is arranged only on the circumference of the waste liquid exhausting point 15-Bk.

With the structure thus arranged, a distance is provided in the gravitational direction between the black ink waste liquid exhaust portion 11-Bk and waste liquid exhausting point 15-Bk to make it possible to prevent the black ink waste liquid exhaust portion 11-Bk from being clogged.

Also, usually, the ratio between the amounts of black ink waste liquid and the color ink waste liquid is approximately 1:3 in most cases. As a result, it is possible to secure the amount of absorption of the color ink in the waste liquid absorbent 13.

(Third Embodiment)

Figure 6:
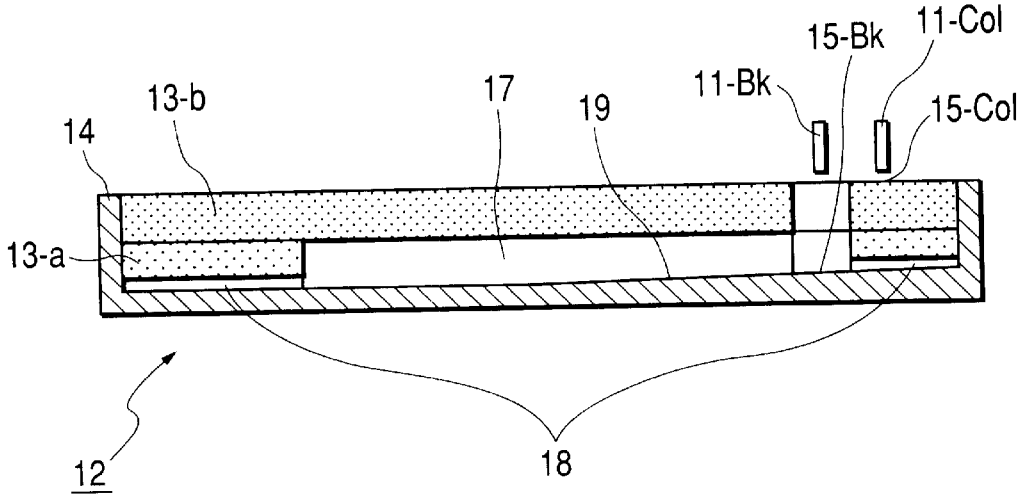
FIG. 6 is a partial cross-sectional view that shows the waste liquid collection member in accordance with the third embodiment of the present invention.

FIG. 6 is a partial cross-sectional view that shows the waste liquid collection member in accordance with a third embodiment of the present invention. For the same parts as those appearing in the second embodiment, the description thereof will be omitted.

On the inner bottom face of the waste liquid collection frame 14, there is provided the inclined portion 19 that becomes lowered in the gravitational direction from the black ink waste liquid exhaust portion 11-Bk toward a position away from the black ink waste liquid exhausting point 15-Bk. Thus, the exhausted black ink expands flatly on the smooth inner bottom face of the waste liquid collection frame 14 and prevents accumulated substance from clogging the black ink waste liquid exhaust portion 11-Bk.

In this respect, the present invention is not necessarily limited to the combination of pigment black ink and dyestuff color ink. The invention obtains the same effects as those described earlier for the combination of dyestuff black ink and pigment color ink or the like.

What is claimed is:

1. An ink jet recording apparatus comprising:

first recovery means for recovering a black ink discharge portion for discharging black ink;

second recovery means for recovering a color ink discharge portion for discharging color ink;

a waste liquid collection member provided with a waste liquid absorbent for absorbing waste liquid exhausted from said first recovery means and said second recovery means, and a waste liquid correction frame for housing said waste liquid absorbent;

a first waste liquid carrying path for carrying waste liquid exhausted from said first recovery means to said waste liquid collection member; and a second waste liquid carrying path for carrying waste liquid exhausted from said second recovery means to said waste liquid collection member, wherein waste liquid exhausted from said first waste liquid carrying path is exhausted to an inner bottom face of said waste liquid collection frame, and waste liquid exhausted from said second waste liquid carrying path is exhausted to said waste liquid absorbent.

2. An ink jet recording apparatus according to claim 1, wherein said color ink discharge portion is formed by a plurality of discharge portions.

3. An ink jet recording apparatus according to claim 1, wherein black ink contains pigment.

4. An ink jet recording apparatus according to claim 1, wherein a distance from an exhaust end of said first waste liquid carrying path to the inner bottom face of said waste liquid collection frame in a gravitational direction is longer than the distance from the exhaust end of said second waste liquid carrying path to said waste liquid absorbent in the gravitational direction.

5. An ink jet recording apparatus according to claim 1, wherein said waste liquid absorbent is provided with a low-density fiber layer on the contact face side with the inner bottom face of said waste liquid collection frame.

6. An ink jet recording apparatus according to claim 1, wherein said waste liquid absorbent has an opening on a circumference of the exhaust position of waste liquid exhausted from the exhaust end of said first waste liquid carrying path.

7. An ink jet recording apparatus according to claim 6, wherein said waste liquid absorbent is provided with a groove for the flowing of waste liquid exhausted from the exhaust end of said first waste liquid carrying path.

8. An ink jet recording apparatus according to claim 7, wherein said waste liquid absorbent covers above said groove with an exception of the circumference of the exhaust position of waste liquid exhausted from the exhaust end of said first waste liquid carrying path.

9. An ink jet recording apparatus according to claim 1, wherein the inner bottom face of said waste liquid collection frame is smooth and flat.

10. An ink jet recording apparatus according to claim 1, wherein the inner bottom face of said waste liquid collection frame is arranged to become lower from the exhaust end of said first waste liquid carrying path toward a position away from the exhaust position of the exhausted liquid in the gravitational direction.

11. An ink jet recording apparatus according to claim 1, wherein electrothermal converting element is provided for generating thermal energy to be utilized for discharging ink.

12. An ink jet recording apparatus according to claim 11, wherein ink is discharged by the utilization of film boiling generated in ink by thermal energy generated by said electrothermal converting element.

13. An ink jet recording apparatus comprising:

first recovery means for recovering a pigment ink discharge portion for discharging pigment ink;

second recovery means for recovering a dyestuff ink discharge portion for discharging dyestuff ink reacting to pigment ink;

a waste liquid collection member provided with a waste liquid absorbent for absorbing waste liquid exhausted from said first recovery means and said second recovery means, and a waste liquid correction frame for housing said waste liquid absorbent;

a first waste liquid carrying path for carrying waste liquid exhausted from said first recovery means to said waste liquid collection member; and a second waste liquid carrying path for carrying waste liquid exhausted from said second recovery means to said waste liquid collection member, wherein waste liquid exhausted from said first waste liquid carrying path is exhausted to an inner bottom face of said waste liquid collection frame, and waste liquid exhausted from said second waste liquid carrying path is exhausted to said waste liquid absorbent.

14. An ink jet recording apparatus according to claim 13, wherein pigment ink is black ink and dyestuff ink is color ink.

15. An ink jet recording apparatus according to claim 13, wherein electrothermal converting element is provided for generating thermal energy to be utilized for discharging ink.

16. An ink jet recording apparatus according to claim 13, wherein ink is discharged by the utilization of film boiling generated in ink by thermal energy generated by said electrothermal converting element.

17. An ink jet recording apparatus according to claim 16, wherein ink is discharged by the utilization of film boiling generated in ink by thermal energy generated by said electrothermal converting element.

18. A waste liquid collection member for use of an ink jet recording apparatus provided with a waste liquid absorbent for absorbing waste liquid, and a waste liquid collection frame housing said waste liquid absorbent, wherein waste liquid exhausted from a black ink discharge portion for discharging black ink is exhausted to an inner bottom face of said waste liquid collection frame, and waste liquid exhausted from the color ink discharge portion for discharging color ink reacting to black ink is exhausted to said waste liquid absorbent.

19. A waste liquid collection member for use of an ink jet recording apparatus provided with a waste liquid absorbent for absorbing waste liquid, and a waste liquid collection frame housing said waste liquid absorbent, wherein waste liquid exhausted from a pigment ink discharge portion for discharging pigment ink is exhausted to an inner bottom face of said waste liquid collection frame, and waste liquid exhausted from a dyestuff ink discharge portion for discharging dyestuff ink reacting to pigment ink is exhausted to said waste liquid absorbent.

* * * * *

UNITED STATES PATENT AND TRADEMARK OFFICE

CERTIFICATE OF CORRECTION

PATENT NO. : 6,623,099 B2
DATED : September 23, 2003
INVENTOR(S) : Matsumura

It is certified that error appears in the above-identified patent and that said Letters Patent is hereby corrected as shown below:

Title page,
Item [54], ABSTRACT,
Lines 19, 22 and 25, “means” should read -- device --.

Column 1,
Line 11, “therefore.” should read -- therefor. --;

Column 2,
Line 24, “from” should read -- form --; and

Column 4,
Line 22, “recovery” should read -- recover --; and

Column 6,
Line 13, “fame” should read -- frame --.

Signed and Sealed this

Twenty-fifth Day of January, 2005

JON W. DUDAS
*Director of the United States Patent and Trademark Office*